US005975689A

United States Patent [19]

Pawlowski, Jr. et al.

[11] Patent Number: 5,975,689

[45] Date of Patent: Nov. 2, 1999

[54] AIR PURGE APPARATUS FOR INKJET PRINT CARTRIDGES

[75] Inventors: Norman E. Pawlowski, Jr., Corvallis, Oreg.; Winthrop D. Childers, San Diego, Calif.

[73] Assignee: Hewlett-Packard Co., Palo Alto, Calif.

[21] Appl. No.: 08/790,874

[22] Filed: Feb. 3, 1997

[51] Int. Cl.[6] ..... B41J 2/175

[52] U.S. Cl. ..... 347/86

[58] Field of Search ..... 347/85, 86, 87, 347/92

[56] References Cited

U.S. PATENT DOCUMENTS

| | | | |
|---|---|---|---|
| 4,558,326 | 12/1985 | Kimura et al. | 347/30 |
| 4,967,207 | 10/1990 | Ruder | 347/7 |
| 5,189,438 | 2/1993 | Hine et al. | 347/89 |
| 5,581,287 | 12/1996 | Baezner | 347/85 |
| 5,583,545 | 12/1996 | Pawlowski, Jr. et al. | 347/7 |
| 5,650,811 | 7/1997 | Seccombe et al. | 347/85 |
| 5,719,609 | 2/1998 | Hauck et al. | 347/85 |
| 5,736,992 | 4/1998 | Pawlowski, Jr. | 347/7 |
| 5,748,216 | 5/1998 | Scheffelin et al. | 347/87 |
| 5,812,168 | 9/1998 | Pawlowski, Jr. et al. | 347/92 |

FOREIGN PATENT DOCUMENTS

| | | |
|---|---|---|
| 0603910 | 6/1994 | European Pat. Off. . |
| 0709206 | 5/1996 | European Pat. Off. . |
| WO94/11194 | 5/1994 | WIPO . |
| WO97/42035 | 11/1997 | WIPO . |
| WO98/2290 | 5/1998 | WIPO . |

OTHER PUBLICATIONS

Patent Abstract for Japanese Application Publication No. 07 025025, published Jan. 27, 1995, by Cannon.

*Primary Examiner*—N. Le
*Assistant Examiner*—Michael Nghiem

[57] ABSTRACT

In one embodiment, an air purge apparatus includes a first station and a second station. The print cartridge is mounted in the first station with its nozzles facing downward. The first station includes a bellows, or any other pump, for pressurizing a diaphragm internal to a regulator-based inkjet print cartridge. This opens a regulator valve which allows air to be purged out of the print cartridge body. The print cartridge is then positioned in the second station with its nozzles facing upwards. The second station includes a pump for supplying a negative pressure to the nozzles of the print cartridge so as to purge air from the manifold of the print cartridge. In another embodiment, the stations are deleted, and the print cartridge is held in place manually. A syringe may be used for the pressure source. In another embodiment, ink at a high pressure is supplied to an ink inlet port of the print cartridge to open the regulator valve and to purge air through the nozzles.

21 Claims, 5 Drawing Sheets

AIR PURGE APPARATUS FOR INKJET PRINT CARTRIDGES

FIELD OF THE INVENTION

This invention relates to inkjet printers and, more particularly, to an air purge apparatus for inkjet print cartridges.

BACKGROUND OF THE INVENTION

Inkjet printers are well known. One common type of inkjet printer uses a replaceable print cartridge which contains a printhead and a supply of ink contained within the print cartridge. The print cartridge is not intended to be refillable and, when the initial supply of ink is depleted, the print cartridge is disposed of and a new print cartridge is installed within the scanning carriage. Frequent replacement of the print cartridge results in a relatively high operating cost.

The printhead has a useable life which is significantly longer than the time it takes to deplete the ink within the print cartridge. It is known to refill print cartridges intermittently by creating an opening through the print cartridge and manually refilling the print cartridge with ink.

It is also known to provide an external, stationary ink reservoir, such as a flaccid bag containing ink, connected to the scanning print cartridge via a tube. Such external ink supplies are referred to as off-axis ink supplies.

Extended use of a print cartridge creates certain problems. Applicants have discovered that there is a diffusion mechanism that has the effect of growing air bubbles in the manifold of the print cartridge and even pressurizing the print cartridge. In particular, during operation, cool ink flows into the manifold and is warmed as it flows toward the printhead. The printhead generates heat as its heater resistors are fired to eject droplets of ink from nozzles. For primarily water-based inks, the solubility of air decreases as it is heated. As a result, air is driven out of the solution, and diffuses into any preexisting bubbles in the manifold. Moreover, because the warmed ink is expelled from the nozzles and replaced with cool ink, there is a steady supply of air from the warming of the ink that diffuses into the preexisting bubbles in the manifold. Eventually, the entire manifold will fill with air.

Excessive air in the manifold of the print cartridge acts as a flow restrictor and will eventually cause printhead starvation. More specifically, accumulation of about 1 cc of air in the manifold will cause print quality defects for high density graphics.

Additionally, air also accumulates in the tubes leading to the print cartridge. Excessive air in the tubes will eventually be drawn into the body of the print cartridge, and thermal excursions will cause the air in the body of the print cartridge to expand. This will eventually lead to non-optimal operation of the print cartridge.

Print cartridges having an internal pressure regulator for regulating the flow of ink from an external source into an ink chamber within the print cartridge have been developed at Hewlett-Packard. Print cartridges including such an internal pressure regulator incorporate a diaphragm in the form of a bag. The inside of the bag is open to the atmosphere. The expansion and contraction of the bag controls the flow of ink into the print cartridge to maintain a relatively constant back pressure at the printhead. However, when roughly 5 cc's of air have accumulated in the body and manifold of the print cartridge, the regulator no longer has the capacity to maintain negative pressure. At that point, air in the printhead will render non-functional any pressure regulator internal to, or leading to, the print cartridge. As a result, the back pressure is lost, or the print cartridge is even pressurized, and ink will drool out of the printhead. A drooling printhead can cause permanent damage to the printer. Moreover, a drooling printhead provides unacceptable print quality. Therefore, the accumulation of excessive air in the body and manifold of print cartridges shortens the useful life of permanent and semi-permanent printheads.

Problems with air accumulation may also occur with print cartridges not having an internal regulator. It is not economical to throw away a print cartridge due to the above described air accumulation.

What is needed is an apparatus for inkjet print cartridges which avoids the air accumulation problems described above.

SUMMARY

In the preferred embodiment, an air purge apparatus includes a first station and a second station. In one example of the use of the air purge apparatus, a print cartridge having an internal pressure regulator is placed in the first station so that its nozzles are facing downward. The first station includes a bellows for pressurizing the internal diaphragm bag of the regulator-based print cartridge. This expands the bag to open the regulator valve and to purge air from the body of the print cartridge via the regulator valve. In another embodiment, the first station includes a diaphragm pump, peristaltic pump, or syringe for purging air from the body of the print cartridge.

The print cartridge is then placed in the second station with its nozzles facing upward. The second station includes a peristaltic pump (or other type of pump) for purging air from the manifold and through the nozzles of the print cartridge. In another embodiment, the second station includes a bellows, diaphragm pump, or syringe for purging air from the manifold of the print cartridge.

In yet another embodiment of the invention, a relatively high positive pressure (e.g., 30 psi) is applied directly to the ink inlet port of the print cartridge to open the regulator valve. Ink is then introduced into the ink inlet port while the nozzles are facing upward to purge air through the nozzles. The regulator valve may also be opened by expanding the diaphragm bag using a pressure source connected to the air intake port.

The print cartridge may then again be used in a printer. The print cartridge may be a disposable, semi-permanent or permanent type.

DETAILED DESCRIPTION OF THE PREFERRED EMBODIMENTS

As previously described, air in the body and manifold of an inkjet print cartridge shortens the useful life of the print cartridge. The present invention provides an air purge apparatus for inkjet print cartridges. The present invention will be described for use with a print cartridge having an internal regulator.

Figure 1:
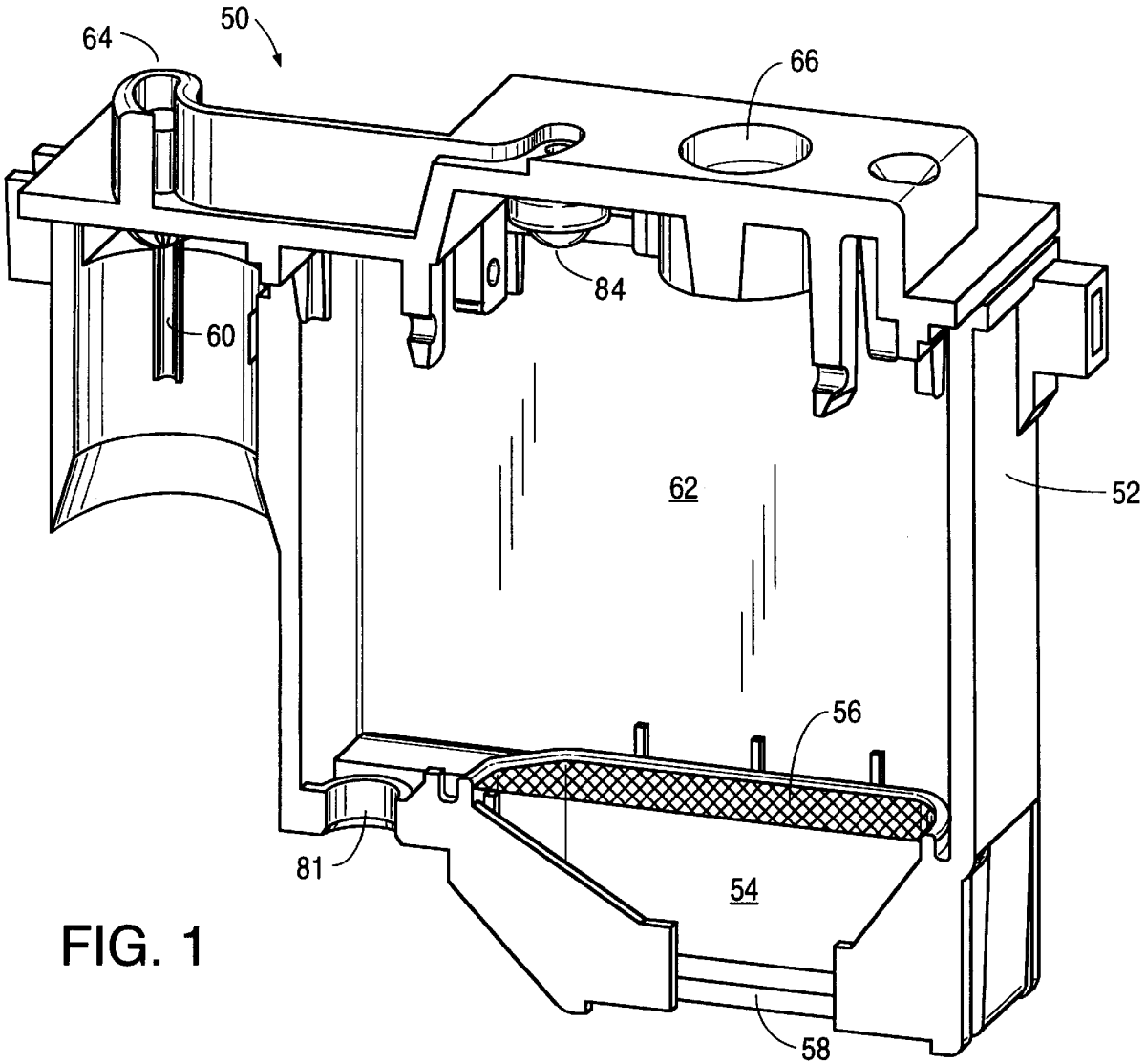
FIG. 1 cross-sectional view of a print cartridge which may use the air purge apparatus.

FIG. 1 illustrates a print cartridge 50 that may be used in the preferred air purge apparatus. Print cartridge 50 includes a body 52 and a manifold 54 leading to a printhead (not shown). A filter screen 56 filters the ink before reaching the printhead. The printhead nozzle array (not shown) is at location 58. A needle 60 is in fluid communication with ink chamber 62 via inlet port 64 for supplying ink to the print cartridge from an external ink supply. An air vent 66 leads to a diaphragm within chamber 62.

Figure 2:
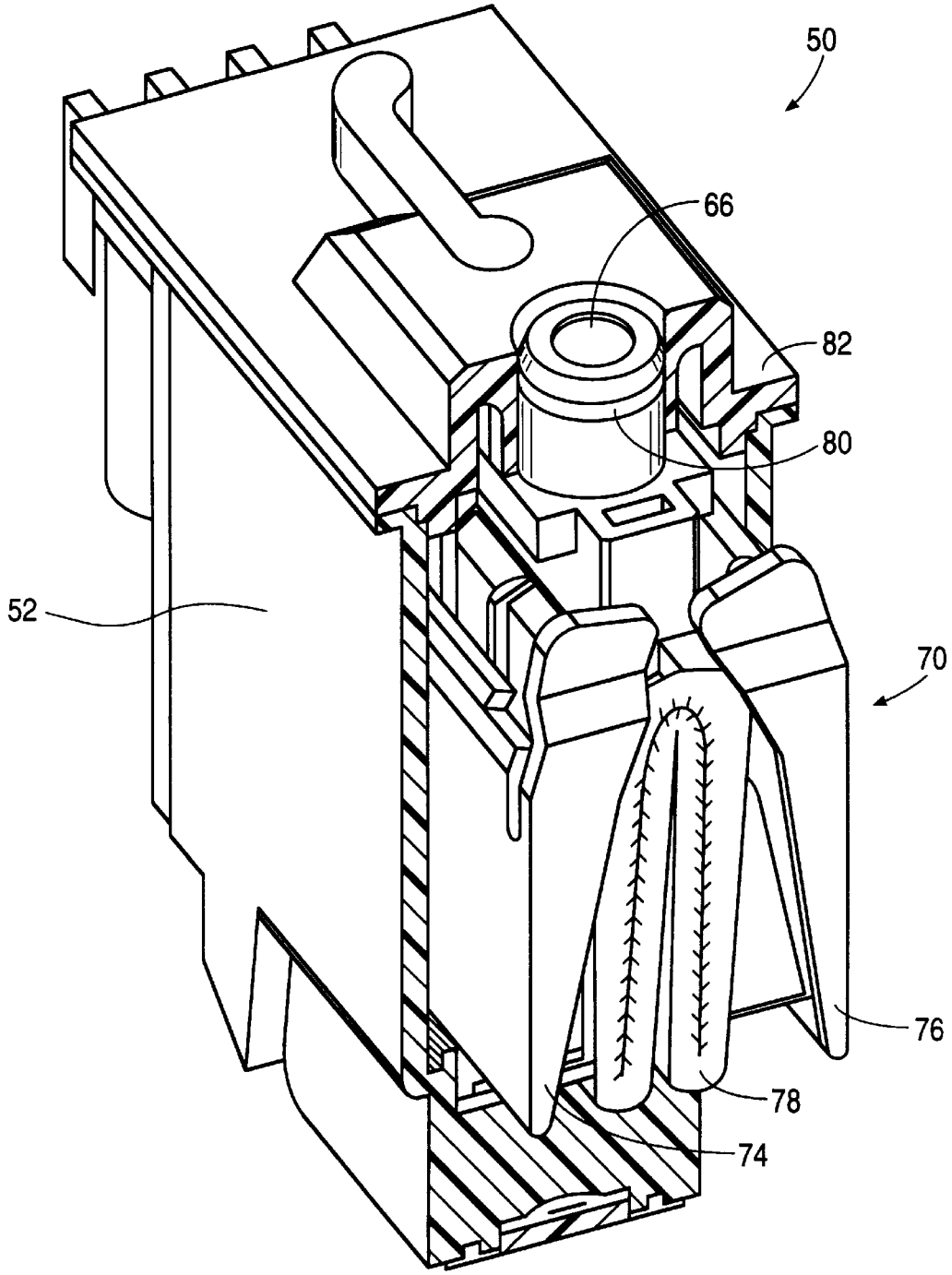
FIG. 2 is a perspective view in partial cross-section of the print cartridge of FIG. 1, illustrating an internal pressure regulator.

FIG. 2 shows the print cartridge 50 with an internal pressure regulator 70. The regulator 70 causes the ink within the ink chamber 62 to have a slight, but substantially constant, negative pressure (e.g., −2 to −7 inches of water column) to prevent ink drool from the nozzles of the printhead. If the off-axis ink supply system (not shown) is at atmospheric pressure, this slight negative pressure in the print cartridge also acts to draw ink from the off-axis ink supply system even if the location of the ink supply system is slightly below the print cartridge. The regulator 70 also enables the use of pressurized off-axis ink supplies while maintaining the desired negative pressure within the ink chamber in the print cartridge.

Located within the body 52 is a pressure regulator lever 74, an accumulator lever 76, and a flexible diaphragm or bag 78.

In FIG. 2, bag 78 is illustrated fully inflated. Pressure regulator lever 74 and accumulator lever 76 are urged together by a spring (not shown). In opposition to the spring, bag 78 spreads the two levers apart as it inflates outward. Bag 78 is staked to a fitment 80 that is press-fit onto crown 82. Fitment 80 contains an air vent 66 to ambient pressure. Vent 66 is in fluid communication with the inside of bag 78 so that the bag is maintained at a reference pressure.

Accumulator lever 76 acts to modulate any fluctuations in the back pressure. Accumulator lever 76 squeezes bag 78, the inside of which is at ambient pressure, forces air out of the bag, and allows air trapped in print cartridge 50 to expand.

Although most of the air accommodation is provided by the movement of accumulator lever 76, there is additional accommodation provided by pressure regulator lever 74 in cooperation with the resilient valve seat 84 (FIG. 1).

As ink is expelled by the printhead onto the medium during printing, the ink back pressure in chamber 62 increases (becomes more negative). As a result, bag 78 expands and pushes apart levers 74 and 76. The pivoting of regulator lever 74 causes a portion of regulator lever 74 to be removed from the inlet 64 (FIG. 1) of the valve seat 84 to allow ink to enter chamber 62 via needle 60.

As the ink back pressure in chamber 62 decreases as ink is supplied to chamber 62, bag 78 exerts less force on the levers, and the spring urges the levers together. The motion of regulator lever 74 compresses the valve seat 84 to restrict the flow of ink into chamber 62.

Additional detail of the print cartridge of FIGS. 1 and 2 may be obtained from U.S. application Ser. No. 08/550,902, filed Oct. 31, 1995, entitled Apparatus for Providing Ink to an Ink-Jet Print Head and for Compensating for Entrapped Air, attorney docket No. 1094910, incorporated herein by reference.

Figure 3:
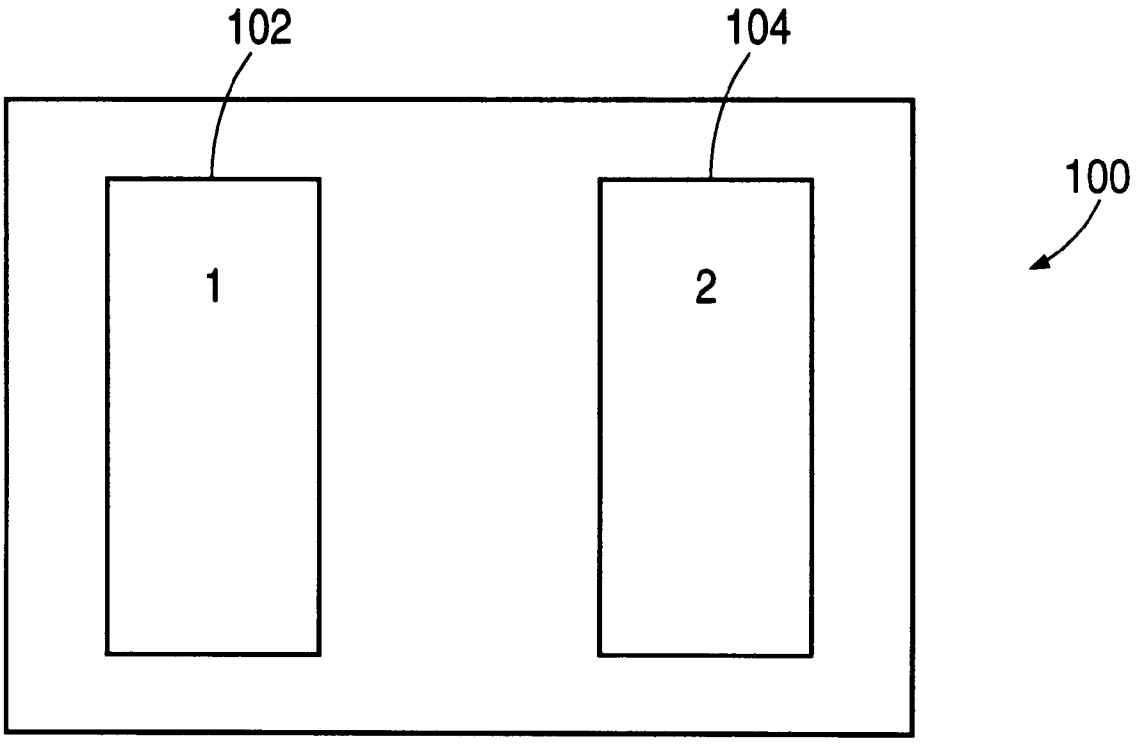
FIG. 3 is a top-view of an air purge apparatus for use with the print cartridge of FIGS. 1 and 2 in accordance with one embodiment of the present invention.

FIG. 3 is a top view of an air purge apparatus 100 for inkjet print cartridges in accordance with one embodiment of the present invention. The air purge apparatus 100 includes a first station 102 and a second station 104.

Figure 4:
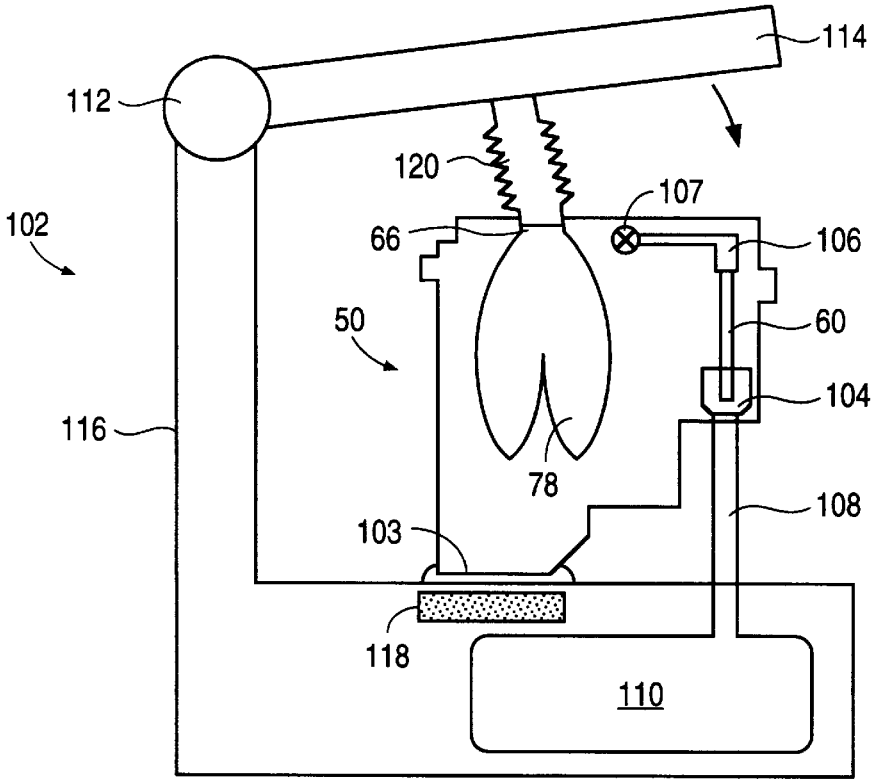
FIG. 4 is a cross-sectional view of the first station of the air purge apparatus of FIG. 3 in accordance with one embodiment of the present invention.

FIG. 4 is a side view in cross-section of the first station 102 of the air purge apparatus 100 in accordance with one embodiment of the present invention. A cross-section of a semi-permanent regulator-based inkjet print cartridge 50, which has been used for printing and which may have air trapped inside of it, is shown installed in the first station 102 with its nozzles 103 facing downward. The first station 102 includes a rubber septum 104 that connects to the needle 60 of print cartridge 50. Needle 60 extends from an ink conduit 106 which leads to the ink inlet valve 107 near the top of print cartridge 50.

Tubing 108, which may be rigid or flexible, connects septum 104 with an ink reservoir 110 such that needle 60 is in fluid communication with the reservoir 110. A hinge 112 connects a lid 114 with a base 116. The first station 102 includes an ink absorbent pad 118 for ink that may be expelled during the air purge. Instead of pad 118, a fluid connection may lead to reservoir 110 to capture the expelled ink.

The first station 102 also includes a bellows 120, or other suitable pump, connected to lid 114. Bellows 120 is coupled to the air vent 66 on print cartridge 50, as the lid 114 is lowered, for pressurizing a diaphragm bag 78 in print cartridge 50. Alternatively, the first station 102 can include a syringe, peristaltic pump, or diaphragm pump for pressurizing the diaphragm bag 78. However, if a diaphragm pump or peristaltic pump is used, a bleed valve may be required to prevent over-pressurization of bag 78.

When lid 114 is lowered, bellows 120 applies air pressure to bag 78. As a result, bag 78 inflates, opening the regulator valve 107 and pressurizing the print cartridge 50. Air that has accumulated in the body of print cartridge 50 is purged from the body of the print cartridge through needle 60 and into reservoir 110. Lid 114 can be opened and closed multiple times to ensure that the body of print cartridge 50 is effectively purged of air.

Ink which is expelled through the nozzles during the above purging process is absorbed by pad 118. Ink pushed back through conduit 106 and needle 60 flows into reservoir 110.

After the above-described purging process, the print cartridge 50 is then mounted in the second station 104.

Figure 5:
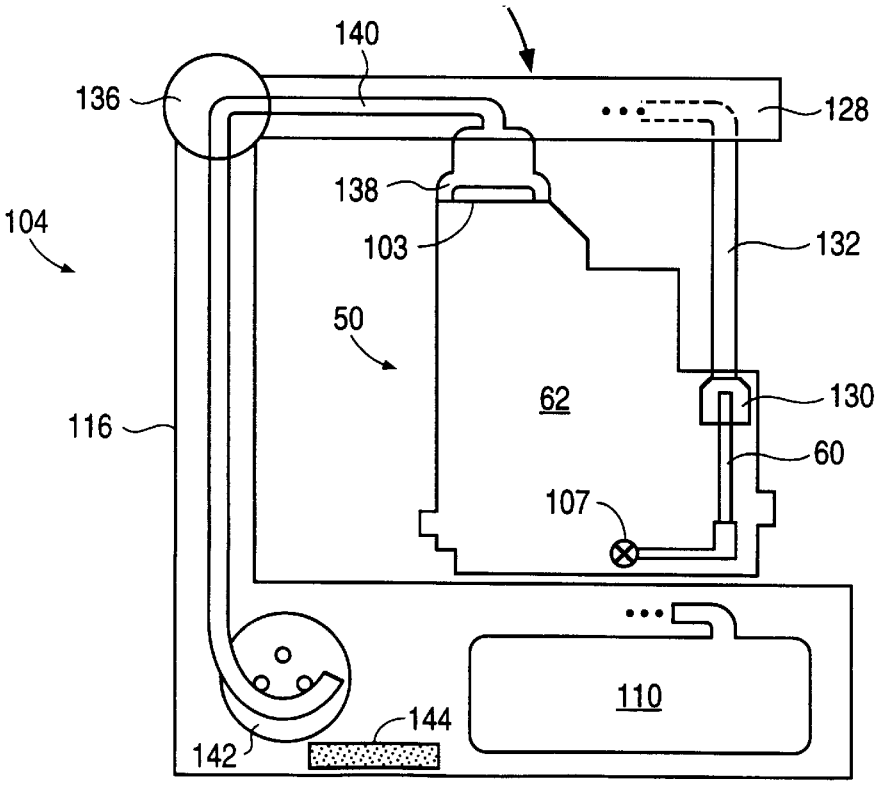
FIG. 5 a cross-sectional view of the second station of the air purge apparatus of FIG. 3 in accordance with one embodiment of the present invention.

In another embodiment, a pump, similar to that described with respect to FIG. 5, is provided to draw air from the nozzles 103 while the print cartridge is in the position shown in FIG. 4. This will also cause bag 78 to inflate, even in the absence of the bellows 120.

FIG. 5 is a side view in cross-section of the second station 104 of the air purge apparatus 100 in accordance with one embodiment of the present invention. The inkjet print cartridge 50 is mounted so that its nozzles 103 face upward. Lid 128 is then closed. The second station 104 provides a rubber septum 130 which connects to needle 60 of print cartridge 50. Tubing 132, which may be rigid or flexible, connects septum 130 to the reservoir 110 such that septum 130 is in fluid communication with reservoir 110. A second reservoir located in lid 128 may also be used. A hinge 136 connects lid 128 with base 116. Lid 128 can be an extension of lid 114.

Lid 128 has a rubber seal 138 which forms an airtight seal around the nozzles 130 of print cartridge 50 when lid 128 is closed. A tube 140 is connected between the sealed area and a pump 142, which may be a peristaltic pump or any other pump. An absorbent pad 144 absorbs any waste ink pumped through tube 140. Alternatively, the waste ink may be pumped back into reservoir 110.

A microswitch which is closed upon closing lid 128 activates pump 142. The peristaltic pump 142 purges air from the manifold of print cartridge 50 through nozzles 130. Alternatively, the second station 104 can include a bellows, diaphragm pump, or syringe for purging air from the manifold of the print cartridge 50. However, inexpensive motors for peristaltic pumps are available and may offer the most user-friendly system. In another embodiment, the first station 102 and the second station 104 use the same pump.

Due to the removal of ink and air through the nozzles, the negative pressure in the print cartridge chamber 62 draws ink from reservoir 110 into chamber 62 via needle 60 and valve 107.

After about ten seconds, pump 142 purges substantially all air from the manifold of print cartridge 50 through the nozzles. The print cartridge 50 is then removed from the second station 104 and installed into an inkjet printer.

Stations 1 and 2 may be used in any order, although the order of station 1, then station 2, is preferred to cause the ink chamber 62 in print cartridge 50 to have a negative pressure prior to installing the purged print cartridge back into an inkjet printer. Further, either station 1 or station 2 may be used, by itself, to obtain increased life from the print cartridge.

Figure 6:
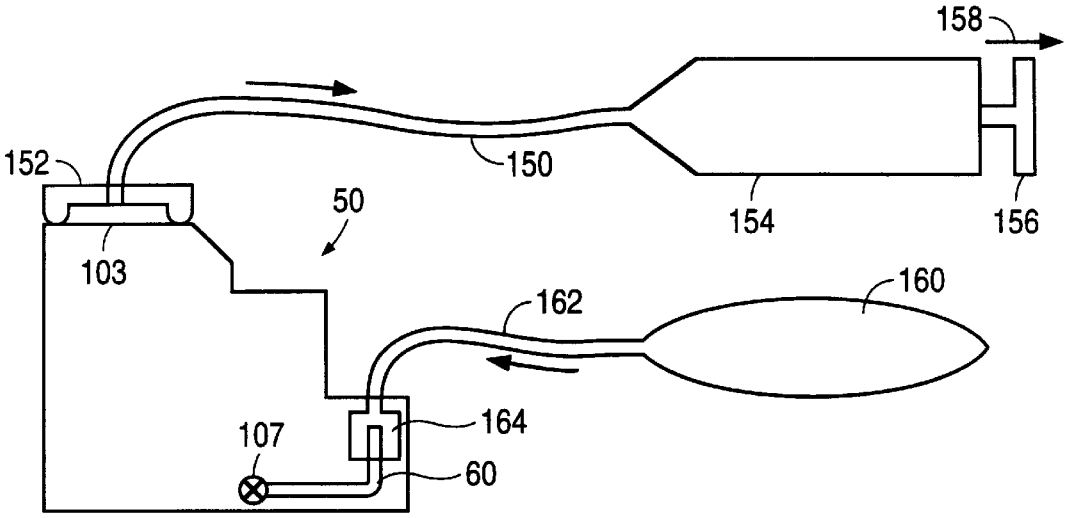
FIG. 6 is similar to FIG. 5, but using a syringe as the negative pressure source.

FIG. 6 illustrates an air purging system performing the same function shown in FIG. 5. In FIG. 6, instead of a peristaltic pump, a negative pressure is supplied to the nozzles 103 by a syringe 154, via tube 150 and seal 152. A plunger 156 is withdrawn from syringe 154 in the direction of arrow 158 to provide the negative pressure to nozzles 103 to remove air trapped in the vicinity of nozzles 103. An ink reservoir 160 is connected to needle 60 of print cartridge 50, via a tube 162 and septum 164, to supply ink to print cartridge 50, via regulator valve 107, as the air is removed through nozzles 103.

Figure 7:
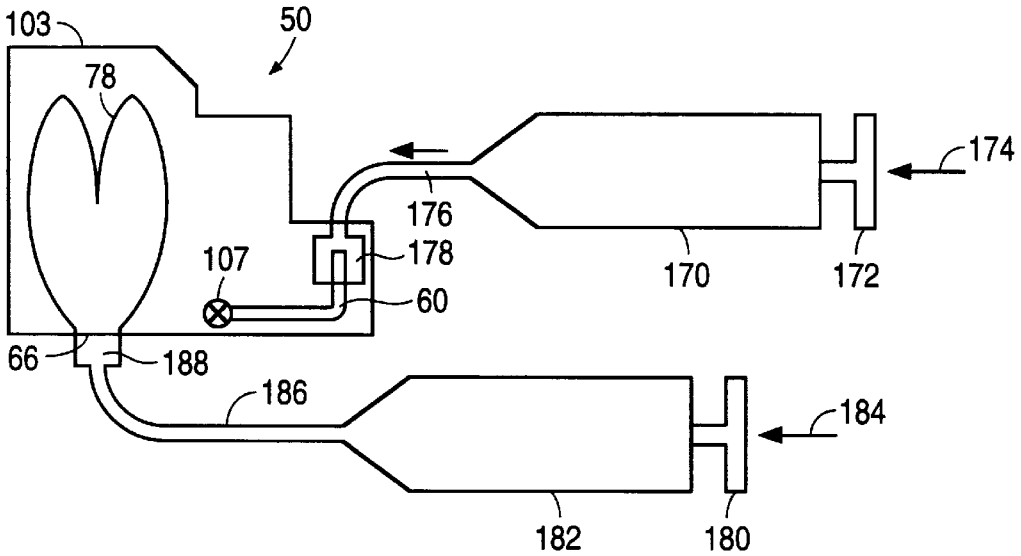
FIG. 7 illustrates an air purge apparatus using a syringe as positive air pressure source for a regulator diaphragm and a syringe as an ink supply.

FIG. 7 illustrates another embodiment of an air purge apparatus wherein air in the vicinity of nozzles 103 is forced out of nozzles 103 by supplying ink, via needle 60, from a pressurized ink source. In the example of FIG. 7, the pressurized ink source is a syringe 170 containing ink, where a plunger 172 is pushed in a direction of arrow 174 to supply ink under pressure, via tube 176 and septum 178, into the print cartridge 50. This introduction of ink pushes any trapped air upwards through nozzles 103. In order to open regulator valve 107, a slight positive pressure is applied to the air vent 66 to expand the diaphragm bag 78 to thereby open the regulator valve 107. In the example of FIG. 7, a plunger 180 of a syringe 182 is pushed in the direction of arrow 184 to supply this air pressure via tube 186 and connector 188.

Figure 8:
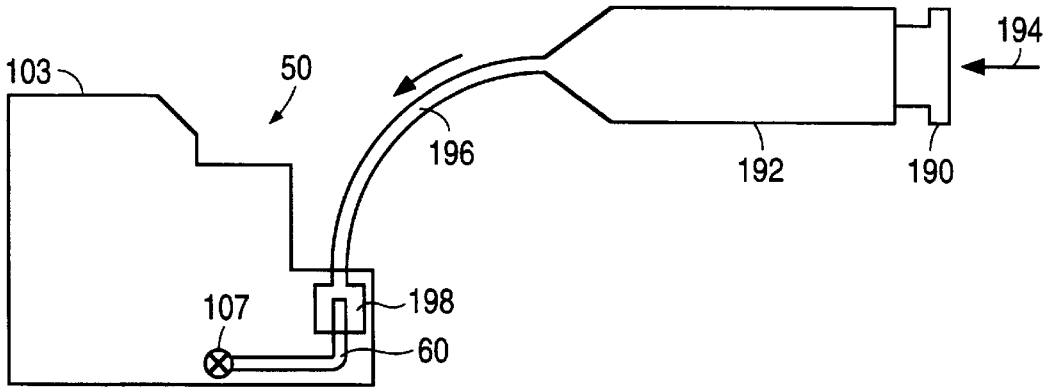
FIG. 8 illustrates an air purge apparatus which supplies ink at a high pressure to an ink inlet port to open a regulator valve and purge air from the print cartridge nozzles.

FIG. 8 illustrates another embodiment of an air purge apparatus, where the regulator valve 107 is forced open by ink at a high pressure supplied to needle 60. This high pressure, using the preferred embodiment print cartridge 50, is on the order of 30 pounds per square inch (psi). In other embodiments, regulator valve 107 may be opened with other pressures, such as between 20–40 psi. In the example shown in FIG. 8, this high pressure is provided by pressing a plunger 190 of a syringe 192 in the direction of arrow 194 such that ink within syringe 192 is introduced through tube 196 and septum 198 into needle 60. A small diameter syringe 192 is preferable to avoid the need for excessive force to achieve the 30 psi. Once regulator valve 107 has been opened and ink is introduced into print cartridge 50, air trapped in the vicinity of nozzles 103 will be expelled through nozzles 103.

In the embodiments shown in FIGS. 5–8, air is purged through nozzles 103 and, thus, nozzles 103 are facing upwards.

The pressure sources shown in the figures may be replaced by any other known pressure sources.

Conclusion

Multiple embodiments of an air purge apparatus have been described which include diaphragm pump, peristaltic pump, or syringe for purging air from the body and manifold of an inkjet print cartridge.

The air purge apparatus may be easily adapted for other types of print cartridges. Modifications to the air purge apparatus to purge air from various types of print cartridges will be apparent to those skilled in the art after reading this disclosure.

The first and second stations in the embodiments of FIGS. 4 and 5 may also be combined into a single station, and the air purge apparatus simply turned upside down to perform the manifold purge operation.

Station 1 or 2 may also be installed in a printer to augment a service station portion of a printer, where the print cartridge is docked when not printing. One example of a printer and service station into which station 1 and/or station 2 may be incorporated is found in U.S. Pat. No. 5,103,244, entitled Method and Apparatus for Cleaning Ink-Jet Printheads, by Gast et al., assigned to the present assignee and incorporated herein by reference.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. An apparatus for removing air from an inkjet print cartridge, said print cartridge having a plurality of ports comprising an air intake port, an ink inlet port, and at least one nozzle port for expelling ink during printing, said print cartridge also having an internal pressure regulator including a regulator valve for regulating a flow of ink entering said print cartridge through said ink inlet port, said regulator having a flexible member with a reference surface communicating with said air intake port, said flexible member for actuating said regulator valve, said apparatus comprising:

a first interface for forming a substantially airtight seal with respect to at least one of said plurality of ports; and at least one pressure generator in communication with said first interface, said at least one pressure generator providing a pressure which flexes said flexible member to actuate, and thereby open, said regulator valve while air is purged from said print cartridge as ink is supplied to said ink inlet port by another pressure generator.

2. The apparatus of claim 1 wherein said at least one pressure generator provides a positive pressure internal to said print cartridge.

3. The apparatus of claim 1 wherein said apparatus purges air from said print cartridge through said at least one nozzle port.

4. The apparatus of claim 1 wherein said at least one pressure generator provides a pressure sufficient to open said regulator valve.

5. The apparatus of claim 1 further comprising an ink supply for providing ink to said print cartridge to replace a volume of air and any ink extracted as air is purged from said print cartridge.

6. The apparatus of claim 5 wherein said apparatus further comprises an ink inlet interface for engaging said ink inlet port to establish a connection between said ink supply and said ink inlet port.

7. The apparatus of claim 1 wherein said flexible member comprises two inflatable bags that are formed of plastic film, an inside surface of each bag defining a reference surface communicating with said air intake port, an outside surface of each bag defining an ink contacting surface.

8. The apparatus of claim 1 further comprising:

a septum for connection to said ink inlet port of said print cartridge; and a conduit for connecting said septum with a reservoir such that said septum is in fluid communication with said reservoir.

9. The apparatus of claim 1 wherein said at least one pressure generator is connected to said air intake port to flex said flexible member and open said regulator valve while air is purged from said print cartridge.

10. The apparatus of claim 1 wherein said first interface forms a substantially airtight seal with respect to said air intake port, and wherein said at least one pressure generator provides a positive air pressure, said another pressure generator including a pressurized ink supply connected to said ink inlet port to purge air through said at least one nozzle port.

11. The apparatus of claim 1 wherein air is purged through said at least one nozzle port when said at least one nozzle port is generally facing upwards.

12. The apparatus of claim 11 wherein said at least one pressure generator provides a positive pressure greater than approximately 20 pounds per square inch.

13. The apparatus of claim 1 wherein said at least one pressure generator comprises a syringe containing air.

14. The apparatus of claim 1 wherein said another pressure generator comprises a syringe containing ink.

15. A system comprising:

a print cartridge having a plurality of ports comprising an air intake port, an ink inlet port, and at least one nozzle port for expelling ink during printing, said print cartridge also having an internal pressure regulator including a regulator valve for regulating a flow of ink entering said print cartridge through said ink inlet port, said regulator having a flexible member with a reference surface communicating with said air intake port, said flexible member for actuating said regulator valve; and an apparatus for removing air from said print cartridge, said apparatus comprising:

a first interface for forming a substantially airtight seal with respect to at least one of said plurality of ports; and at least one pressure generator in communication with said first interface, said at least one pressure generator providing a pressure which flexes said flexible member to actuate, and thereby open, said regulator valve while air is purged from said print cartridge as ink is supplied to said ink inlet port by another pressure generator.

16. The system of claim 15 wherein said air intake port is generally facing downward when said print cartridge is connected to said apparatus for purging air from said print cartridge.

17. A method for purging air from an inkjet print cartridge, said print cartridge having a plurality of ports comprising an air intake port, an ink inlet port, and at least one nozzle port for expelling ink during printing, said print cartridge also having an internal pressure regulator including a regulator valve for regulating a flow of ink entering said print cartridge through said ink inlet port, said regulator having a flexible member with a reference surface communicating with said air intake port, said flexible member for actuating said regulator valve, said method comprising the steps of:

placing a first interface with respect to at least one of said plurality of ports, said first interface communicating with a pressure generator; and providing a pressure by said pressure generator to flex said flexible member to actuate, and thereby open said regulator valve while air is purged from said print cartridge as ink is supplied to said ink inlet port by another pressure generator.

18. The method of claim 17 wherein said step of placing said first interface with respect to said at least one of said plurality of ports comprises forming a seal with respect to said air intake port, and said step of providing a pressure comprises providing a positive pressure to said air intake port.

19. The method of claim 17 further comprising the step of supplying ink to said print cartridge while purging air from said print cartridge.

20. The apparatus of claim 1 wherein said another pressure generator provides ink at a positive pressure relative to ambient pressure.

21. The apparatus of claim 1 wherein said another pressure generator provides ink at a positive pressure relative to a pressure internal to said print cartridge.

* * * * *